US011410792B2

(12) United States Patent
Ooshima et al.

(10) Patent No.: US 11,410,792 B2
(45) Date of Patent: Aug. 9, 2022

(54) MULTICORE CABLE

(71) Applicant: SUMITOMO ELECTRIC INDUSTRIES, LTD., Osaka (JP)

(72) Inventors: Takumi Ooshima, Tochigi (JP); Masayuki Ishikawa, Tochigi (JP); Jo Yagisawa, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/268,728

(22) PCT Filed: May 22, 2020

(86) PCT No.: PCT/JP2020/020361
§ 371 (c)(1),
(2) Date: Feb. 16, 2021

(87) PCT Pub. No.: WO2020/241508
PCT Pub. Date: Dec. 3, 2020

(65) Prior Publication Data

US 2022/0115164 A1 Apr. 14, 2022

(30) Foreign Application Priority Data

May 28, 2019 (WO) ..... PCT/JP2019/021154

(51) Int. Cl.
*H01B 7/02* (2006.01)
*H01B 7/18* (2006.01)
*H01B 7/00* (2006.01)

(52) U.S. Cl.
CPC ..... *H01B 7/18* (2013.01); *H01B 7/0009* (2013.01)

(58) Field of Classification Search
CPC ..... H01B 1/026; H01B 3/307; H01B 3/302; H01B 7/295; H01B 7/045; H01B 3/50; H01B 3/54; H01B 11/02; H01B 11/04
USPC ..... 174/110 R, 113 R, 36
See application file for complete search history.

(56) References Cited

U.S. PATENT DOCUMENTS

| | | | | |
|---|---|---|---|---|
| 6,242,097 | B1 | 6/2001 | Nishiguchi et al. | |
| 9,905,338 | B2 * | 2/2018 | Hashimoto | H01B 7/295 |
| 10,102,944 | B2 | 10/2018 | Kohori et al. | |
| 2008/0105454 | A1 | 5/2008 | Morioka et al. | |
| 2010/0147549 | A1 * | 6/2010 | Shiina | H01B 7/295 174/120 SR |
| 2010/0322572 | A1 | 12/2010 | Sakabe et al. | |
| 2014/0326480 | A1 * | 11/2014 | Hashimoto | H01B 7/295 174/113 R |

(Continued)

FOREIGN PATENT DOCUMENTS

| | | |
|---|---|---|
| CN | 101426848 | 5/2009 |
| CN | 101622564 | 1/2010 |

(Continued)

*Primary Examiner* — William H. Mayo, III
(74) *Attorney, Agent, or Firm* — IPUSA, PLLC

(57) ABSTRACT

A multicore cable includes:
a plurality of coated electric wires; and
an outer coating that covers an outer periphery of the plurality of coated electric wires,
wherein the coated electric wires each includes a conductor and an insulating layer that covers the conductor, and
wherein, in a range of 0.1 mm from an outer surface of the outer coating, a storage modules of the outer coating at −30° C. is greater than or equal to 300 MPa and less than or equal to 500 MPa.

12 Claims, 4 Drawing Sheets

(56) References Cited

U.S. PATENT DOCUMENTS

| | | | | |
|---|---|---|---|---|
| 2015/0144375 | A1* | 5/2015 | Hashimoto | H01B 1/026 174/113 R |
| 2015/0165987 | A1* | 6/2015 | Hayakawa | H01B 7/0045 174/72 A |
| 2015/0235736 | A1 | 8/2015 | Ikeda et al. | |
| 2018/0005723 | A1 | 1/2018 | Kohori et al. | |

FOREIGN PATENT DOCUMENTS

| | | |
|---|---|---|
| CN | 104170026 | 11/2014 |
| CN | 206849519 U | 1/2018 |
| JP | H06-212073 | 8/1994 |
| JP | H08-241630 | 9/1996 |
| JP | H11-053945 | 2/1999 |
| JP | 4894262 | 3/2012 |
| JP | 2018-032515 | 3/2018 |
| JP | 2018-125311 | 8/2018 |
| WO | 2005/013291 | 2/2005 |
| WO | 2007/118659 | 10/2007 |

* cited by examiner

MULTICORE CABLE

The present application is based on and claims priority to International Application No. PCT/JP2019/021154, filed on May 28, 2019, the entire contents of the International Application being hereby incorporated herein by reference.

TECHNICAL FIELD

The present disclosure relates to a multicore cable.

BACKGROUND ART

Patent Document 1 discloses a multicore cable for a vehicle including two coated electric wires and a jacket that covers the two coated electric wires.

PRIOR ART DOCUMENT

[Patent Document]

[Patent Document 1] Japanese Laid-open Patent Publication No. 2018-32515

SUMMARY OF THE INVENTION

According to one aspect of the present disclosure, a multicore cable includes:

a plurality of coated electric wires; and an outer coating that covers an outer periphery of the plurality of coated electric wires, wherein the coated electric wires each includes a conductor and an insulating layer that covers the conductor, and wherein, in a range of 0.1 mm from an outer surface of the outer coating, a storage modules of the outer coating at −30° C. is greater than or equal to 300 MPa and less than or equal to 500 MPa.

EMBODIMENT FOR CARRYING OUT THE INVENTION

Figure 1:
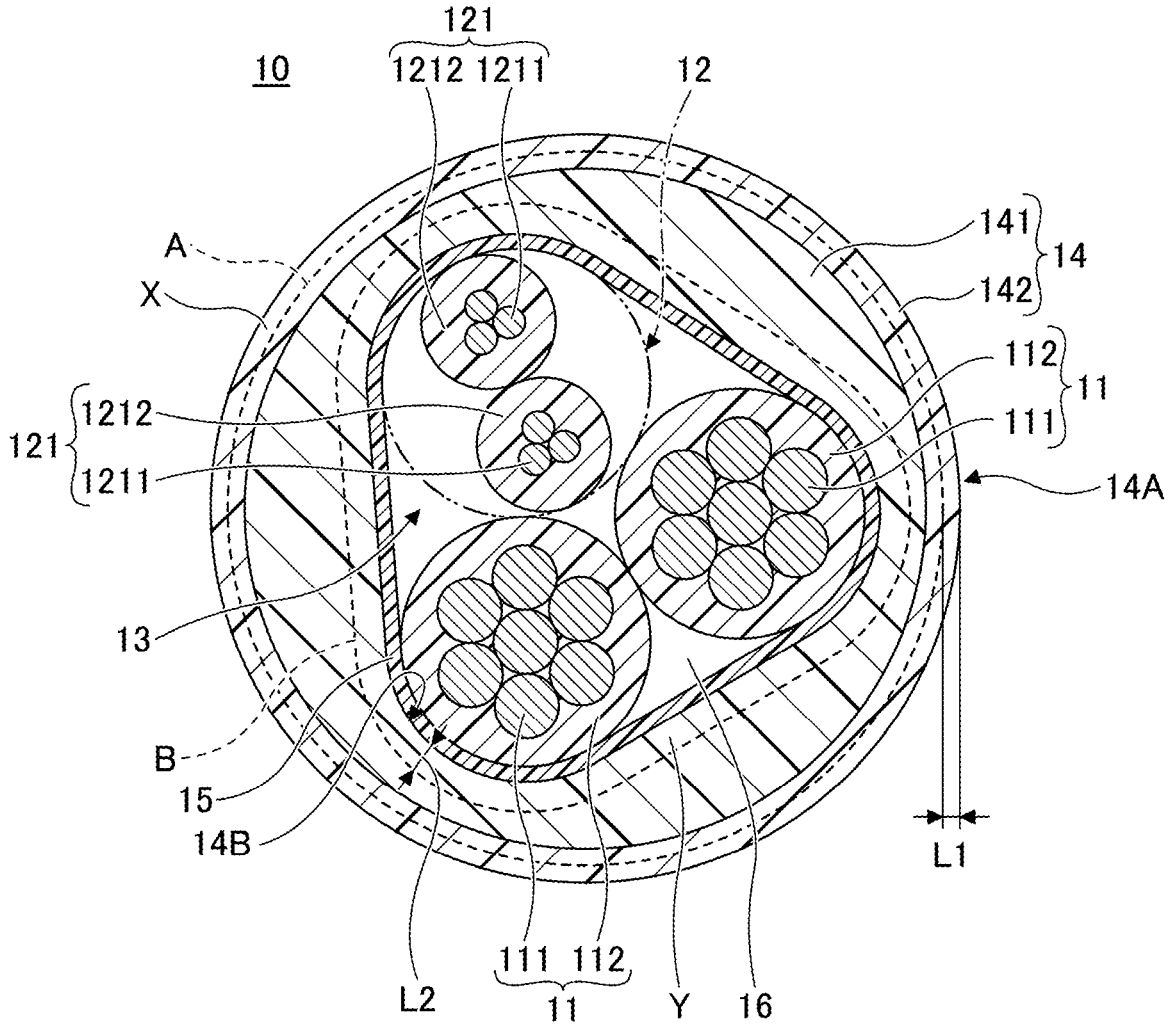
FIG. 1 is a cross-sectional view perpendicular to the longitudinal direction of a multicore cable according to one aspect of the present disclosure.

Problem to be Solved by the Present Disclosure

Wheels are displaceably supported relative to body of a vehicle and the positions of the wheels are displaced relative to the body of the vehicle, for example, when the vehicle is in use. Therefore, a multicore cable that connects a control device mounted on the body of the vehicle and an electric parking brake or the like provided around the wheels may be repeatedly bent. For this reason, from the viewpoint of increasing the durability of the multicore cable, high resistance to bending is required.

It is an object of the present disclosure to provide a multicore cable that is excellent in resistance to bending.

Effect of the Present Disclosure

According to the present disclosure, it is possible to provide a multicore cable that is excellent in resistance to bending.

Embodiments will be described below.

Description of Embodiments of the Present Disclosure

To begin with, aspects of the present disclosure are listed and described below. In the following description, the same reference characters are allotted to the same or corresponding elements and the same descriptions thereof are not repeated.

(1) According to one aspect of the present disclosure, a multicore cable includes:

a plurality of coated electric wires; and an outer coating that covers an outer periphery of the plurality of coated electric wires, wherein the coated electric wires each includes a conductor and an insulating layer that covers the conductor, and wherein, in a range of 0.1 mm from an outer surface of the outer coating, a storage modules of the outer coating at −30° C. is greater than or equal to 300 MPa and less than or equal to 500 MPa.

By making the storage modulus of the outer coating in the range of 0.1 mm from the outer surface of the outer coating at −30° C. less than or equal to 600 MPa, sufficient flexibility can be imparted for the outer surface side of the outer coating. In this way, by imparting sufficient flexibility to the outer surface side of the outer coating, the outer surface side of the outer coating of the multicore cable can be deformed even in a case in which a force is applied to the multicore cable. Thus, in a case in which a force is applied to the multicore cable, the outer coating does not hider deformation inside the multicore. Therefore, it is considered that disconnection of coated electric wires such as a power wire inside the multicore cable can be suppressed and the resistance to bending can be enhanced.

Especially in an environment below the freezing point, although the storage modulus of the outer coating decreases and the multicore cable does not easily deform in accordance with a force applied from the outside, it is required to increase the resistance to bending even in such an environment. Therefore, as described above, it is preferable that the storage modulus of the outer coating of the area at −30° C. satisfies the range described above.

It should be noted that the outer coating also has a function to protect the coated electric wires from flying objects such as stepping stones and to prevent the coated electric wires from being damaged. Therefore, for example, in a case in which stepping stones or the like collide with the outer periphery of the multicore cable, from the viewpoint of protecting the coated electric wires, such as an inside power wire, it is preferable that the storage modulus of the outer coating in the range of 0.1 mm from the outer surface of the outer coating at −30° C. is greater than or equal to 100 MPa.

Then, in the range of 0.1 mm from the outer surface of the outer coating, by making the storage modulus of the outer coating at −30° C. greater than or equal to 300 MPa and less than or equal to 500 MPa, the resistance to bending can be further enhanced while sufficiently protecting the coated electric wires from being damaged by flying objects such as stepping stones.

(2) In the range of 0.1 mm from the outer surface of the outer coating, the storage modules of the outer coating at −30° C. may be greater than or equal to 300 MPa and less than or equal to 400 MPa.

(3) In a range of 0.1 mm from an inner surface of the outer coating located toward the plurality of coated electric wires, a storage modulus of a resin material of the outer coating at −30° C. may be less than a storage modulus of the outer surface of the outer coating at −30° C.

(4) The outer coating may include a first coating layer and a second coating layer in order from the plurality of coated electric wires side, and a storage modulus of the second coating layer at −30° C. may be greater than or equal to 300 MPa and less than or equal to 500 MPa.

(5) The storage modulus of the second coating layer at −30° C. may be greater than or equal to 300 MPa and less than or equal to 400 MPa.

(6) A storage modulus of the first coating layer at −30° C. may be less than a storage modulus of the outer surface of the outer coating at −30° C.

(7) The outer coating may include a first coating layer and a second coating layer in order from the plurality of coated electric wires side, and a storage modulus of the first coating layer at −30° C. may be greater than or equal to 100 MPa and less than or equal to 500 MPa, and a storage modulus of the second coating layer at −30° C. may be greater than or equal to 100 MPa and less than or equal to 600 MPa, and the storage modulus of the first coating layer at −30° C. may be less than a storage modulus of the outer surface of the outer coating at −30° C.

(8) The outer coating may include a first coating layer and a second coating layer in order from the plurality of coated electric wires side, and storage modulus of the first coating layer at −30° C. may be greater than or equal to 100 MPa and less than or equal to 400 MPa, and a storage modulus of the second coating layer at −30° C. may be greater than or equal to 300 MPa and less than or equal to 500 MPa, and the storage modulus of the first coating layer at −30° C. may be less than a storage modulus of the outer surface of the outer coating at −30° C.

(9) The outer coating may include a first coating layer and a second coating layer in order from the plurality of coated electric wires side, and a storage modulus of the first coating layer at −30° C. may be greater than or equal to 100 MPa and less than or equal to 300 MPa, and a storage modulus of the second coating layer at −30° C. may be greater than or equal to 300 MPa and less than or equal to 400 MPa, and the storage modulus of the first coating layer at −30° C. may be less than a storage modulus of the outer surface of the outer coating at −30° C.

(10) The second coating layer may contain a polyurethane resin including one or more kinds selected from antimony trioxide, aluminum hydroxide, magnesium hydroxide, and talc.

(11) According to one aspect of the present disclosure, a multicore cable includes:

a plurality of coated electric wires including a power wire and a twisted pair signal wire; and an outer coating that covers an outer periphery of the plurality of coated electric wires, wherein the power wire includes a plurality of conductors twisted together and an insulating layer that covers the plurality of conductors, wherein the twisted pair signal wire includes two signal wires twisted together, wherein the outer coating includes a first coating layer and a second coating layer in order from the plurality of coated electric wires side, wherein the second coating layer consists of only a polyurethane resin including one or more kinds selected from antimony trioxide, aluminum hydroxide, magnesium hydroxide, and talc and has a storage modulus at −30° C. of greater than or equal to 300 MPa and less than or equal to 500 MPa, and wherein a storage modulus of the first coating layer at −30° C. is less than a storage modulus of an outer surface of the outer coating at −30° C.

Details of Embodiment of the Present Disclosure

Specific examples of multicore cables according to one embodiment of the present disclosure (hereinafter referred to as "the present embodiment") will be described below with reference to the drawings. It should be noted that the present invention is not limited to these examples but is set forth in the claims and is intended to include all modifications within the meanings and the scope equivalent to the claims.

First, the configuration of a multicore cable according to the present embodiment will be described with reference to FIG. 1 to FIG. 3.

FIG. 1 illustrates a cross-sectional view in a plane perpendicular to the longitudinal direction of a multicore cable 10 according to the present embodiment.

As illustrated in FIG. 1, the multicore cable 10 according to the present embodiment can include a plurality of coated electric wires. The coated electric wires each includes a conductor and an insulating layer that covers the conductor. Although FIG. 1 illustrates, as a plurality of coated electric wires, a case including two power wires 11 and a twisted pair signal wire 12 including two signal wires 121, the configuration of a plurality of coated electric wires included in the multicore cable according to the present embodiment is not limited to such a configuration.

The multicore cable 10 in the present embodiment can also include an outer coating 14 that covers the outer periphery of the plurality of coated electric wires. Then, the storage modulus of the outer coating 14 at −30° C. in the range of 0.1 mm from the outer surface 14A of the outer coating 14 can be 100 MPa or more and 600 MPa or less.

The plurality of coated electric wires included in the multicore cable according to the present embodiment are not limited to the configuration example illustrated in FIG. 1 as described above. Depending on a device or the like to which the multicore cable is connected, coated electric wires having configurations as desired can be included by a number as desired. Other configuration examples of a plurality of coated electric wires included in a multicore cable according to the present embodiment will be described below.

Figure 2:
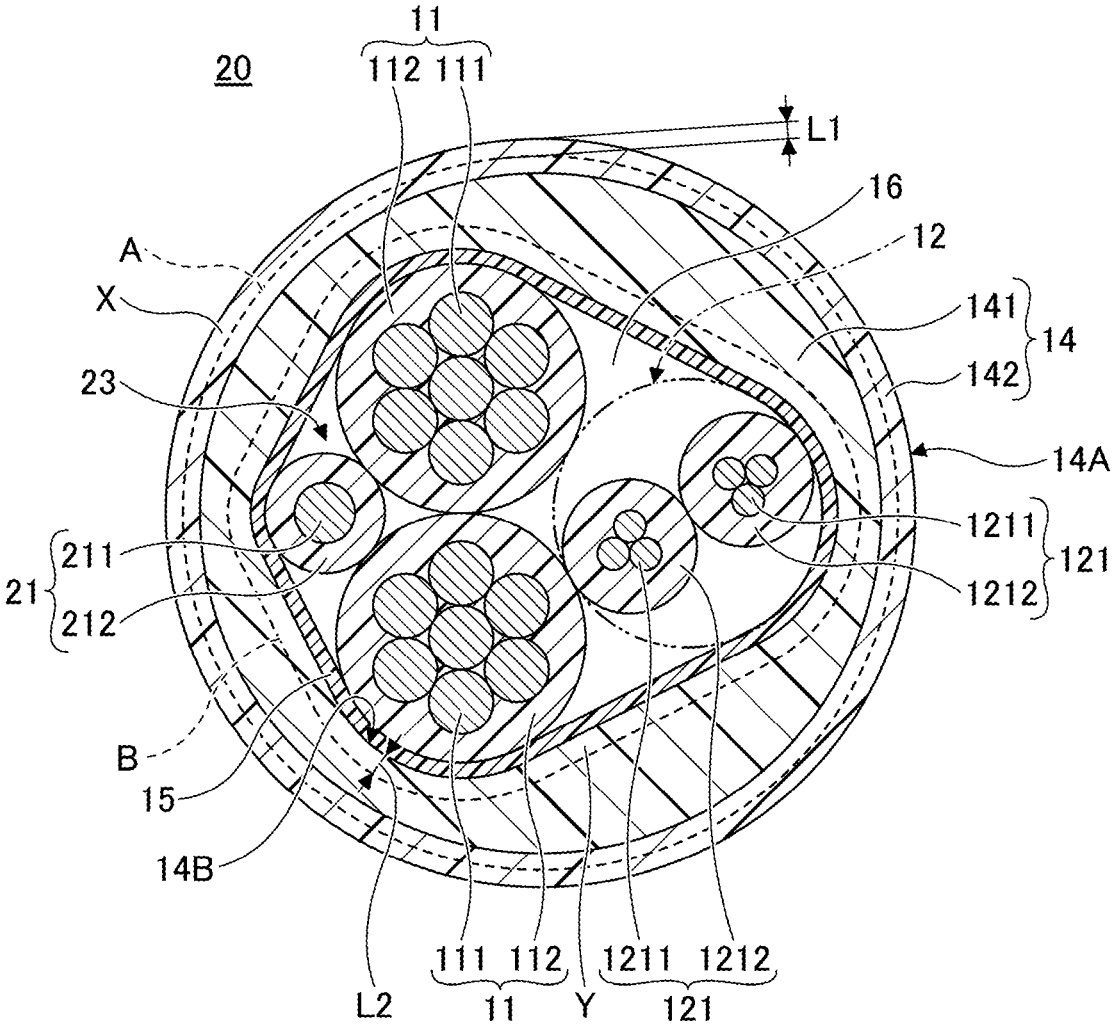
FIG. 2 is another configuration example of a cross-sectional view perpendicular to the longitudinal direction of a multicore cable according to one aspect of the present disclosure.
Figure 3:
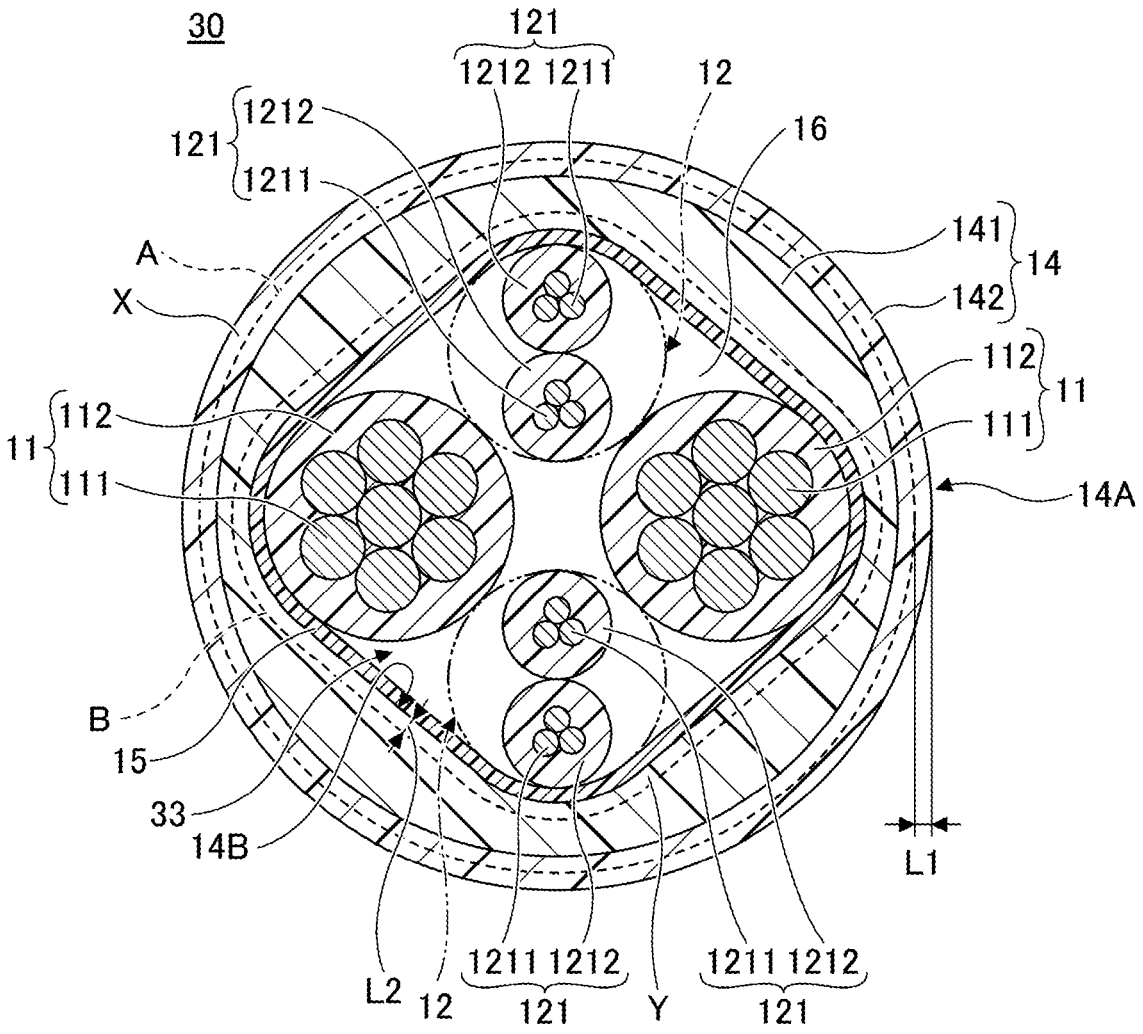
FIG. 3 is another configuration example of a cross-sectional view perpendicular to the longitudinal direction of a multicore cable according to one aspect of the present disclosure.

FIG. 2 illustrates a cross-sectional view in a plane perpendicular to the longitudinal direction of a multicore cable 20 that is another configuration example according to the present embodiment, and FIG. 3 illustrates a cross-sectional view in a plane perpendicular to the longitudinal direction of a multicore cable 30 that is another configuration example according to the present embodiment.

For example, the multicore cable 20 illustrated in FIG. 2 includes, in addition to two power wires 11 and a twisted pair signal wire 12 containing two signal wires 121, a single electric wire 21. Also, for example, the multicore cable 30 illustrated in FIG. 3 includes two power wires 11 and two twisted pair signal wires 12 each containing two signal wires 121. In this manner, a multicore cable can include a desired number of coated electric wires with a desired configuration.

In the following, each member of the multicore cable according to the present embodiment will be described.

(1) Coated Electric Wire

As discussed above, the multicore cable of the present embodiment can include a plurality of coated electric wires. The configuration of a plurality of coated electric wires is not particularly limited, and the configuration can be selected as desired depending on a device to be connected or a voltage to be applied. The multicore cable according to the present embodiment can include, as coated electric wires, one or more kinds selected from, for example, a power wire, a signal wire, an electric wire, and the like.

Configuration examples of a power wire, a signal wire, and an electric wire as coated electric wires will be described below.

(1-1) Power Wire

A power wire 11 can include first conductors 111 and a first insulating layer 112 that covers the first conductors 111. It should be noted that each of the multicore cable 10, the multicore cable 20, and the multicore cable 30 illustrated in FIG. 1 to FIG. 3 includes two power wires 11, and the two power wires can be the same in size and material.

The two power wires 11 can be used to connect, for example, an electric parking brake (EPB) and an electronic control unit (ECU). The EPB includes a motor that drives the brake caliper. For example, one of the power wires 11 may be used as a power supply wire to supply electric power to a motor and the other of the power wires 11 may be used as a ground wire of the motor.

The first conductors 111 can be configured by twisting together a plurality of conductors. A wire made of copper or a copper alloy can be used for conductors. Other than copper and a copper alloy, conductors can be made of materials having a predetermined degree of conductivity and flexibility, such as a tin-plated soft copper wire and a soft copper wire. Conductors may be made of hard copper wire. The cross-sectional area of the first conductor 111 can be 1.4 $mm^2$ or more and 3 $mm^2$ or less. It should be noted that the power wire 11 can also include a plurality of first conductors 111.

The first insulating layer 112 may be made of a composition having a synthetic resin as the main component and is layered on the outer periphery of the first conductors 111 to coat the first conductors 111. The average thickness of the first insulating layer 112 is not particularly limited, but can be, for example, 0.1 mm or more and 5 mm or less. Here, the "average thickness" means the average value of thicknesses measured at any ten points. It should be noted that in the following, the "average thickness" is also similarly defined for other members and the like.

The main component of the first insulating layer 112 is not particularly limited if it has an insulating property, and from the viewpoint of enhancing the flexibility at low temperatures, a copolymer of ethylene and an α-olefin having a carbonyl group (hereinafter, also referred to as a main component resin) is preferable. The lower limit of the content of the α-olefin having a carbonyl group of the main component resin described above is preferably 14% by mass and is more preferably 15% by mass. On the other hand, the upper limit of the content of the α-olefin having a carbonyl group is preferably 46% by mass and is more preferably 30% by mass. It is preferable to have the content of the α-olefin having a carbonyl group greater than or equal to the lower limit as described above because it is possible to particularly increase the resistance to bending at a low temperature. Further, it is preferable to have the content of the α-olefin having a carbonyl group less than or equal to the upper limit as described above because it is possible to increase the mechanical characteristics such as the strength of the first insulating layer 112.

As the α-olefin having a carbonyl group, it is preferable to select one or more kinds of: (meth) acrylic acid alkyl esters such as methyl (meth) acrylate and ethyl (meth) acrylate; (meta) acrylic acid aryl esters such as phenyl (meth) acrylate; vinyl esters such as vinyl acetate and vinyl propionate; unsaturated acids such as (meth) acrylic acid, crotonic acid, maleic acid, itaconic acid; vinyl ketones such as methyl vinyl ketone and phenyl vinyl ketone; (meth) acrylic acid amide, and the like. Among these, one or more kinds selected from (meth) acrylic acid alkyl esters and vinyl esters are more preferred, and one or more kinds selected from ethyl acrylate and vinyl acetate are further preferred.

Examples of the main component resin described above include resins such as an ethylene-vinyl acetate copolymer (EVA), an ethylene-ethyl acrylate copolymer (EEA), am ethylene-methyl acrylate copolymer (EMA), and an ethylene-butyl acrylate copolymer (EBA). Among these, one or more kinds selected from EVA and EEA are preferable.

The first insulating layer 112 may contain additives such as a flame retardant, a flame retardant aid, an antioxidant, a lubricant, a colorant, a reflection imparting agent, a concealing agent, a processing stabilizer, a plasticizer, and the like. The first insulating layer 112 may also contain other resins other than the main component resin described above.

The upper limit of the content of other resins, is preferably 50% by mass, is more preferably 30% by mass, and is further more preferably 10% by mass. The first insulating layer 112 may also be substantially free of other resins.

Examples of the flame retardant include halogen-based flame retardants such as brominated flame retardants and chlorine-based flame retardants, non-halogen-based flame retardants such as metal hydroxides, nitrogen-based flame retardants, and phosphorous-based flame retardants, and the like. A single kind of flame retardants may be used alone or two or more kinds may be used in combination.

Examples of brominated flame retardants include decabromodiphenylethane and the like. Examples of chlorine-based flame retardants include chlorinated paraffins, chlorinated polyethylenes, chlorinated polyphenols, perchlorpentacyclodecane, and the like. Examples of metal hydroxides include magnesium hydroxide, aluminum hydroxide, and the like. Examples of nitrogen-based flame retardants include melamine cyanurate, triazine, isocyanurate, urea, guanidine, and the like. Examples of phosphorus-based flame retardants include phosphinic acid metal salt, phosphaphenanthrene, melamine phosphate, ammonium phosphate, phosphoric acid ester, polyphosphazene, and the like.

As the flame retardant, from the viewpoint of reducing the environmental load, a non-halogen-based flame retardant is preferable, and metal hydroxide, a nitrogen-based flame retardant, and a phosphorus-based flame retardant are more preferable.

In a case in which the first insulating layer 112 contains a flame retardant, the lower limit of the flame retardant content in the first insulating layer 112 is preferably 10 parts by mass and is more preferably 50 parts by mass with respect to 100 parts by mass of the resin component. On the other hand, the upper limit of the content of the flame retardant is preferably 200 parts by mass and is more preferably 130 parts by mass with respect to 100 parts by mass of the resin component. In a case in which the content of the flame retardant is less than the lower limit as described above, the flame retardant effect may not be sufficiently imparted. Conversely, when the content of the flame retardant exceeds the upper limit as described above, the extrusion moldability of the first insulating layer 112 may be impaired, and the mechanical properties such as elongation and tensile strength may be impaired.

In the first insulating layer 112, the resin component is preferably crosslinked. Examples of the method of crosslinking the resin component of the first insulating layer 112 include a method of irradiating with ionizing radiation, a method of using a thermal crosslinking agent, and a method of using a silane graftmer, and a method of irradiating with ionizing radiation is preferable. Also, in order to promote crosslinking, it is also preferable that a silane coupling agent be added to the composition that forms the first insulating layer 112.

(1-2) Signal Wire

A signal wire 121 includes second conductors 1211 that are thinner than the first conductors 111 and a second insulating layer 1212 that covers the second conductors 1211. The signal wires 121 can be twisted together in a pair of two wires to constitute the twisted pair signal wire 12. The two signal wires 121 twisted together along the longitudinal direction can be the same in size and material. The twist pitch of the twisted pair signal wire 12 is not particularly limited, but for example, can be four times or more and ten times or less of the twist diameter of the twisted pair signal wire 12 (the outside diameter of the twisted pair signal wire 12).

In a case in which the multicore cable includes a power wire 11 and a twisted pair signal wire 12, the outer diameter of the twisted pair signal wire 12 can be approximately the same as the outer diameter of the power wire 11.

The signal wires 121 can also be used to transmit a signal from a sensor and can also be used to transmit a control signal from an ECU. The two signal wires 121 can be used, for example for wiring of an Anti-lock Brake System (ABS). The respective two signal wires 121 can be used, for example, for wires that connect a differential wheel speed sensor and an ECU of a vehicle. The two signal wires 121 may also be used to transmit other signals.

The second conductors 1211 may be composed of a single conductor or may be composed by twisting a plurality of conductors together similarly to the power wires 11. The second conductors 1211 may be made of the same material as the conductors composing the first conductors 111 described above, or may be made by using a different material. The cross-sectional area of the second conductor 1211 is not particularly limited, but can be, for example, 0.13 $mm^2$ or more and 0.5 $mm^2$ or less. It should be noted that the signal wire 121 may also include a plurality of second conductors 1211.

The material of the second insulating layer 1212 is not particularly limited, but, for example, can be made of a flame retardant polyolefin-based resin, such as cross-linked polyethylene, to which flame retardancy is imparted by mixing a flame retardant. The material of the second insulating layer 1212 is not limited to a flame retardant polyolefin-based resin, and may be made of another material such as a cross-linked fluorine-based resin. The outer diameter of the second insulating layer 1212 can be, for example, 1.0 mm or more and 2.2 mm or less.

(1-3) Electric Wire

As illustrated by a multicore cable 20 of FIG. 2, the multicore cable according to the present embodiment may also include an electric wire 21 as a coated electric wire.

The electric wire 21 includes a third conductor 211 that is thinner than the first conductors 111 and a third insulating layer 212 that covers the third conductor 211. The electric wire 21 may be the same size and material as a signal wire 121.

The electric wires 21 can be used to transmit signals from a sensor, or can be used to transmit control signals from an ECU, or they can be used as power feeders to provide electric power to an electronic device. The electric wires 21 can also be used as ground wires.

The third conductor 211 may be composed of a single conductor or may be composed by twisting a plurality of conductors together similarly to the power wires 11. The third conductors 211 may be made of the same material as the conductors composing the first conductors 111 or the second conductors 1211, or may be made by using a different material. The cross-sectional area of the third conductor 211 is not particularly limited, but can be, for example, 0.13 $mm^2$ or more and 0.5 $mm^2$ or less. It should be noted that the electric wire 21 may include a plurality of third conductors 211.

The third insulating layer 212 may be made of the same material as the second insulating layer 1212 or may be made by using a different material. The outer diameter of the third insulating layer 212 can be 1.0 mm or more and 2.2 mm or less.

Two electric wires 21 are used and may be twisted together to compose a twisted pair electric wire. In this case, it is preferable that the two electric wires 21 twisted together are of the same size and material. In a case in which the electric wires are arranged as a twisted pair electric wire with a twisted pair signal wire in a multicore cable, it is preferable that the twisted pair electric wire and the twisted pair signal wire 12 are twisted in the same direction. Also, in this case, it is preferable that the twisted pair electric wire and the twisted pair signal wire 12 are at the same twist pitch. The outer diameter of the twisted pair electric wire can be approximately the same as the outer diameter of the twisted pair signal wire 12. The outer diameter of the twisted pair electric wire can be approximately the same as the outer diameter of the power wire 11.

As described above, the configuration of a plurality of coated electric wires included in the multicore cable according to the present embodiment is not particularly limited. Depending on a device or the like to which the multicore cable is connected, coated electric wires having configurations as desired can be included by a number as desired. It should be noted that, similarly to the multicore cables 10, 20, and 30 illustrated in FIG. 1 to FIG. 3, a multicore cable preferably includes a plurality of coated electric wires including a power wire 11 and a twisted pair signal wire 12. This is because a multicore cable including a power wire 11 and a twisted pair signal wire 12 can be used for a variety of applications, and can be a multicore cable that is highly versatile.

The power wire 11 and the twisted pair signal wire 12 can have the configurations as described above, and for example, a power wire can include a plurality of conductors twisted together and an insulating layer that covers the plurality of conductors. Also, the twisted pair signal wire 12 can include two signal wires twisted together.

It should be noted that although power wires, signal wires, and an electric wire have been described as examples of the coated electric wires, the first conductors 111, the second conductors 1211, and the third conductors 211 described above correspond to conductors of the coated electric wires described above. Also, the first insulating layers 112, the second insulating layers 1212, and the third insulating layer 212 correspond to insulating layers of the coated electric wires described above.

(2) Outer Coating

As described above, the multicore cable of the present embodiment can include a plurality of coated electric wires selected from the power wires 11, the signal wires 121, the electric wire 21, and the like. The plurality of coated electric wires can then be twisted together along the longitudinal direction to form a core.

Specifically, for example, in the case of the multicore cable 10 illustrated in FIG. 1, a core 13 can be configured by twisting two power wires 11 and a single twisted pair signal wire 12 together. Further, in the case of the multicore cable 20 illustrated in FIG. 2, a core 23 can be configured by twisting two power wires 11, a single twisted pair signal wire 12, and an electric wire together. In the case of the multicore cable 30 illustrated in FIG. 3, a core 33 can be formed by twisting two power wires 11 and two twisted pair signal wires 12.

The total twist diameter of the core obtained by twisting together a plurality of coated electric wires can be, for example, 5.5 mm or more and 9 mm or less.

Also, the twist pitch of the core obtained by twisting together a plurality of coated electric wires is not particularly limited, but for example, can be 12 times or more and 24 times or less of the twist diameter of the core. By making the twist pitch of the core to 24 times or less of the twist diameter of the core, it is possible to prevent the twisting from becoming loose, and to particularly enhance the resistance to bending. Further, by making the twist pitch of the core 12 times or more of the twist diameter of the core, the productivity of the multicore cable can be particularly increased.

It should be noted that in a case in which a core includes a twisted pair signal wire 12, the ratio of the twist pitch of the core to the twist diameter of the core is preferably greater than the ratio of the twist pitch of the twisted pair signal wire 12 to the twist diameter of the twisted pair signal wire 12. The twisting direction of the core is not particularly limited, but is preferably in the same direction as the twisting direction of the twisted pair signal wire 12.

The multicore cable of the present embodiment can include an outer coating 14 that covers the outer periphery of a plurality of coated electric wires, that are a core. At this time, the outer coating 14 can be arranged to completely cover the plurality of coated electric wires, i.e., the core.

Then, according to the investigation by the inventors of the present invention, in the range of 0.1 mm from the outer surface 14A of the outer coating 14, by making the storage modulus of the outer coating 14 at −30° C. greater than or equal to 100 MPa and less than or equal to 600 MPa, the resistance to bending of the multicore cable can be particularly increased.

As illustrated in FIG. 1 to FIG. 3, an area X is defined between the outer surface 14A of the outer coating 14 and a dotted line A where a distance L1 from the outer surface 14A is 0.1 mm. In a cross-section perpendicular to the longitudinal direction of the multicore cable, the outer surface 14A of the multicore cable is typically circular in shape, the dotted line A where the distance L1 from the outer surface 14A of 0.1 mm is similar in shape to the outer surface 14A along the outer surface 14A, and therefore the area X is circular in shape. It should be noted that the "circle" for the shape of the outer surface 14A of the multicore cable in a cross-section perpendicular to the longitudinal direction of the multicore cable means not only a circle in a strict sense that is a true circle, but also includes a circle other than a true circle, such as an ellipse, within a tolerance acceptable to the multicore cable.

Then, in this case, the storage modulus of the outer coating 14 at −30° C. in the area X is preferably 100 MPa or more and 600 MPa or less, is more preferably 300 MPa or more and 500 MPa or less, and is further more preferably 300 MPa or more and 400 MPa or less.

As described above, for example, multicore cables are used in vehicles such as automobiles, and may be repeatedly bent at the time of use in vehicles or the like. For this reason, from the viewpoint of increasing the durability of the multicore cable, high resistance to bending is required. It should be noted that a multicore cable having a high resistance to bending means a multicore cable, in a case in which the multicore cable is repeatedly bent, for which a number of repeated bends required to increase the resistance value due to an occurrence of a crack or disconnection of coated electric wires included in the multicore cable.

Then, according to the earnest investigation by the inventors of the present invention, by making the storage modulus of the outer coating in the above described area X at −30° C. less than or equal to 600 MPa, sufficient flexibility can be imparted for the outer surface side of the outer coating. In this way, by imparting sufficient flexibility to the outer surface side of the outer coating, the outer surface side of the outer coating of the multicore cable can be deformed even in a case in which a force is applied to the multicore cable. Thus, in a case in which a force is applied to the multicore cable, deformation inside the multicore cable is not hindered. Therefore, it is considered that disconnection of coated electric wires such as a power wire inside the multicore cable can be suppressed and the resistance to bending can be enhanced.

Especially in an environment below the freezing point, although the storage modulus of the outer coating decreases and the multicore cable does not easily deform in accordance with a force applied from the outside, it is required to increase the resistance to bending even in such an environment. Therefore, as described above, it is preferable that the storage modulus of the outer coating of the area X at −30° C. satisfies the range described above.

It should be noted that the outer coating also has a function to protect the coated electric wires from flying objects such as stepping stones and to prevent the coated electric wires from being damaged. Therefore, for example, in a case in which stepping stones or the like collide with the outer periphery of the multicore cable, from the viewpoint of protecting the coated electric wires, such as an inside power wire, it is preferable that the storage modulus of the outer coating in the above described area X at −30° C. is greater than or equal to 100 MPa.

By making the storage modulus of the outer coating 14 at −30° C. in the range of 0.1 mm from the outer surface of the outer coating 14 greater than or equal to 300 MPa and less than or equal to 500 MPa, the resistance to bending can be further enhanced while sufficiently protecting the coated electric wires from being damaged by flying objects such as stepping stones.

Also, by making the storage modulus of the outer coating 14 at −30° C. in the range of 0.1 mm from the outer surface of the outer coating 14 greater than or equal to 300 MPa and less than or equal to 400 MPa or less, the resistance to bending can be particularly enhanced while sufficiently protecting the coated electric wires from being damaged by flying objects such as stepping stones.

It should be noted that in the outer coating 14, not only the area X, but also the entire outer coating 14 may satisfy a preferable range of the storage modulus as described above.

It should be noted that in the multicore cable of the present embodiment, it is preferable that the storage modulus of the resin material of the outer coating 14 at −30 C° in the range of 0.1 mm from the inner surface 14B of the outer coating 14 located toward the plurality of coated electric wires be lower than the storage modulus of the outer surface 14A of the outer coating 14 at −30 C°.

As illustrated in FIG. 1 to FIG. 3, an area Y is defined between the inner surface 14B of the outer coating 14 located toward the plurality of coated electric wires and a dotted line B where a distance L2 from the inner surface 14B is 0.1 mm. In this case, it is preferable that the storage modulus of the resin material of the outer coating 14 at −30° C. in the area Y be lower than the storage modulus of the outer surface 14A of the outer coating 14 at −30° C.

In the outer coating 14, by making the storage modulus of the resin material of the outer coating 14 at −30° C. in the area Y located toward the plurality of coated electric wires such as the power wires 11 lower than the storage modulus of the outer surface 14A of the outer coating 14 at −30° C., the flexibility of the outer coating 14 of the area Y can be particularly increased. Thus, even in a case in which a plurality of coated electric wires such as the power wire 11 are displaced or deformed, such displacement or the like can be absorbed by the area Y of the outer coating 14 at the area Y. Therefore, disconnection of a plurality of coated electric wires can be particularly suppressed and the resistance to bending of the multicore cable can be particularly enhanced.

The specific range of the storage modulus of the resin material of the outer coating 14 at −30° C. in the area Y is not particularly limited, but, for example, is preferably 500 MPa or less, is more preferably 400 MPa or less, and is further more preferably 300 MPa or less.

By making the storage modulus of the outer coating 14 at −30° C. in the above described area Y less than or equal to 500 MPa, sufficient flexibility can be imparted for the outer coating 14 in the area Y. Thus, because the displacement or deformation of a plurality of coated electric wires that occurs when a force is applied to the multicore cable is not hindered, disconnection of the plurality of coated electric wires such as a power wire inside the multicore cable can be suppressed and the resistance to bending of the multicore cable can be enhanced.

By making the storage modulus of the outer coating 14 at −30° C. in the above described area Y less than or equal to 400 MPa, disconnection of coated electric wires such as a power wire inside the multicore cable can be further suppressed and the resistance to bending can be further enhanced. By making the storage modulus of the outer coating 14 at −30° C. in the above described area Y less than or equal to 300 MPa, disconnection of coated electric wires such as a power wire inside the multicore cable can be particularly suppressed and the resistance to bending can be particularly enhanced.

Especially in an environment below the freezing point, although the storage modulus of the outer coating decreases and the multicore cable does not easily deform in accordance with a force applied from the outside, it is required to increase the resistance to bending even in such an environment. Therefore, as described above, it is preferable that the storage modulus of the outer coating at the area Y at −30° C. satisfies the range as described above.

It should be noted that as described above, because the outer coating 14 also has a function to protect the plurality of coated electric wires, the storage modulus of the resin material of the outer coating 14 at −30° C. in the area Y is preferably 10 MPa or more, and is more preferably 100 MPa or more.

The configuration of the outer coating 14 is not particularly limited and can be comprised of a plurality of layers made of different materials to have the desired storage modulus. The outer coating 14 may also be comprised of one layer.

Specifically, for example, the outer coating 14 may include a first coating layer 141 and a second coating layer 142 in order from the side of the plurality of coated electric wires, such as the power wires 11.

As described above, it is preferable that the outer coating 14 be composed of a plurality of layers, because it makes it possible to easily adjust the storage modulus thereof depending on the location of the outer coating 14.

As described above, in a case in which the outer coating 14 includes the first coating layer 141 and the second coating layer 142, for example, the storage modulus of the second coating layer 142 at −30° C. is preferably 100 MPa or more and 600 MPa or less, is more preferably 300 MPa or more and 500 MPa or less, and is further more preferably 300 MPa or more and 400 MPa or less.

This is because, by making the storage modulus of the second coating layer 142 in the range as described above, for example, the storage modulus of the outer coating in the area X described above can be easily made in the desired range. It should be noted that in this case, it is preferable that the second coating layer 142 includes, for example, the outer surface 14A of the outer coating 14. That is, the second coating layer 142 is preferably arranged on the outermost peripheral side of the outer coating 14.

In addition, the thickness of the second coating layer 142 is not particularly limited, but for example, is preferably 0.1 mm or more, and is more preferably 0.3 mm or more. It should be noted that although the upper limit of the thickness of the second coating layer 142 is not particularly limited, but is preferably 1.0 mm or less and is more preferably 0.8 mm or less.

Also, as described above, in a case in which the outer coating 14 includes the first coating layer 141 and the second coating layer 142, for example, it is preferable that the storage modulus of the first coating layer 141 at −30° C. is lower than the storage modulus of the outer surface 14A of the outer coating 14 at −30° C.

This is because, by making the storage modulus of the first coating layer 141 in the range as described above, for example, the storage modulus of the outer coating in the area Y described above can be easily made in the desired range. It should be noted that in this case, it is preferable that the first coating layer 141 includes, for example, the inner surface 14B of the outer coating 14. That is, it is preferable that the first coating layer 141 is arranged on the innermost peripheral side of the outer coating 14, in other words, on the plurality of coated electric wires side.

In addition, the thickness of the first coating layer 141 is not particularly limited, but for example, the minimum value of the thickness, that is, the thickness of the thinnest portion is preferably 0.1 mm or more, and is more preferably 0.3 mm or more. It should be noted that the upper limit of the thickness of the thinnest portion of the first coating layer 141 is not particularly limited, but is preferably 1.0 mm or less and is more preferably 0.8 mm or less.

The specific range of the storage modulus of the first coating layer 141 at −30° C. is not particularly limited, but for example, is preferably 500 MPa or less, is more preferably 400 MPa or less, and is further more preferably 300 MPa or less. The lower limit value of the storage modulus of the first coating layer 141 at −30° C. is not particularly limited, but for example, is preferably 10 MPa or more and is more preferably 100 MPa or more.

This is because, by making the storage modulus of the first coating layer 141 in the range as described above, for example, the storage modulus of the outer coating in the area Y described above can be easily made in the desired range. In this case also, it is preferable that the first coating layer 141 includes, for example, the inner surface 14B of the outer coating 14. That is, it is preferable that the first coating layer 141 is arranged on the innermost peripheral side of the outer coating 14, in other words, on the plurality of coated electric wires side.

The material of the outer coating 14 is not particularly limited, but can be made of a polyolefin-based resin, such as polyethylene or ethylene-vinyl acetate copolymer (EVA), a polyurethane elastomer (polyurethane resin), a polyester elastomer, or a composition obtained by mixing at least two kinds of these.

For example, "Solumer 851T" (trade name, manufactured by SK Global Chemical Co., Ltd) is commercially available as polyethylene, and for example, "Evaflex EV360" (trade name, manufactured by DuPont-Mitsui Polychemicals Co., Ltd) is commercially available as EVA, and they can be selected for use as appropriate from various grades of commercially available products.

Also, for example, a crosslinked/non-crosslinked thermoplastic polyurethane (TPU) excellent in wear resistance can be used as the material of the outer coating 14. Because of being excellent in thermal resistance, a cross-linked thermoplastic polyurethane can be preferably used as the material of the outer coating 14. As a thermoplastic polyurethane, for example, "Elastollan ET385" (trade name, manufactured by BASF) and "Miractran E385PNAT-N" (trade name, manufactured by Tosoh Corporation) are commercially available, and it can be selected for use as appropriate from various grades of commercially available products.

The specific method of making the storage modulus of the outer coating 14 within the desired range at −30° C. is not particularly limited. For example, by selecting the material, density, and the like of the outer coating 14, the desired storage modulus can be achieved. It is possible also, by mixing, for example, an inorganic material such as a flame retardant into a resin material of the outer coating 14, to adjust its storage modulus. In a case in which an inorganic substance, such as a flame retardant, is mixed with the resin material of the outer coating 14, the mixing ratio is not particularly limited. For example, with respect to 100 parts by mass of the resin material, an inorganic substance, such as a flame retardant, is preferably added so as to be 12 parts by mass or less, and is more preferably added so as to be 10 parts by mass or less.

Because there is a possibility that the storage modulus increases when the amount of the inorganic material added with respect to 100 parts by mass is excessive, the amount of added is preferably less than or equal to 12 parts by mass.

Examples of the inorganic material to be added include one or more kinds selected from antimony trioxide, aluminum hydroxide, magnesium hydroxide, and talc.

The outer coating 14 can include the first coating layer 141 and the second coating layer 142 as described above. In this case, the first coating layer 141 and the second coating layer 142 may be made of different materials or may be made of a same material. Also, for example, in the first coating layer 141 and the second coating layer 142, by changing the amount of an additive of an inorganic material such as a flame retardant, the storage modulus of each layer can be adjusted.

The materials of the first coating layer 141 and the second coating layer 142 are not particularly limited, and for example, materials described with respect to the outer coating 14 can be used.

As the material of the first coating layer 141, one or more kinds selected from a polyurethane resin and a polyethylene resin can be preferably used. In order to adjust the storage modulus as described above, the first coating layer 141 may further contain an inorganic material, such as a flame retardant, as needed.

As the material of the second coating layer 142, a polyurethane resin that is excellent in wear resistance can be preferably used. Because the second coating layer 142 is arranged on the outside of the multicore cable, the durability of the multicore cable can be particularly enhanced by using a polyurethane resin as the material of the second coating layer 142.

In order to adjust the storage modulus as described above, the second coating layer 142 may also further contain an inorganic material, such as a flame retardant. Therefore, for example, the second coating layer 142 preferably contains a polyurethane resin including one or more kinds selected from antimony trioxide, aluminum hydroxide, magnesium hydroxide, and talc. It is also possible to constitute the second coating layer 142 only by a polyurethane resin including one or more kinds selected from antimony trioxide, aluminum hydroxide, magnesium hydroxide, and talc.

By configuring the second coating layer 142 with the material described above, the durability of the multicore cable can be particularly increased, and the storage modulus of the second coating layer 142 can be easily adjusted.

The multicore cable of the present embodiment can further include members as desired other than the plurality of coated electric wires and the outer coating described above.

For example, a suppression winding 15 may be provided to cover the outer periphery of the plurality of coated electric wires. The suppression winding 15 covers a core obtained by twisting together the plurality of coated electric wires. By arranging the suppression winding 15, the shape obtained by twisting together the plurality of coated electric wires constituting the core can be stably maintained. The suppression winding 15 can be provided on the inside of the outer coating 14.

For example, a paper tape, a non-woven fabric, a tape made of resin such as polyester, or the like can be used as the suppression winding 15. The suppression winding 15 can also be spirally wound along the longitudinal direction of the core, or may be configured in a longitudinal manner such that the longitudinal direction of suppressor paper is arranged along the longitudinal direction of the core. Also, the winding direction may be Z-winding or S-winding. In a case in which the core 13 includes a twisted pair signal wire 12 or the like, the winding direction of the suppression winding 15 can be the same as the twist direction of the twisted pair signal wire 12 or the like included in the core 13, or may be wound in the opposite direction. However, it is preferable that the winding direction of the suppression winding 15 be opposite to the twist direction of the twisted pair signal wire 12 or the like, because protrusions/recesses do not easily occur on the surface of the suppression winding 15 and the outer diameter shape of the multicore cable is easily stabilized.

It should be noted that because the suppression winding 15 has a cushioning function to increase flexibility and has a protection function from the outside, in a case in which the suppression winding 15 is provided, layer(s) of the outer coating 14 can be thinned. By providing the suppression winding 15 in this manner, it is possible to provide a multicore cable that is more flexible and has superior wear resistance.

Also, in a case in which the outer coating 14 made of resin is provided by extrusion coating, the resin may enter between a plurality of coated electric wires, making it difficult to separate the plurality of coated electric wires at the end of the multicore cable. Thus, by providing the suppression winding 15, it is possible to prevent the resin from entering between the plurality of coated electric wires and to easily extract the plurality of coated electric wires, such as power wires, at the terminal.

Also, the multicore cable of the present embodiment may include, for example, an interposed portion in the area 16 between the outer coating 14 and the core. The interposed portion can be composed of fibers such as rayon and nylon yarn. The interposed portion may be composed of tensile strength fibers.

The interposed portion can be arranged in a gap that is formed between coated electric wires, such as between power wires 11 or between a power wire 11 and a signal wire 121.

Although the embodiments have been described in detail above, it is to be understood that various variations and modifications may be made within the scope of the appended claims, and are not limited to specific embodiments.

EXAMPLES

Although specific Examples will be described below, the present invention is not limited to these Examples.

(Evaluation Method)

First, methods for evaluating multicore cables prepared in the following Experimental Examples will be described.

(1) Evaluation of Storage Modulus of Outer Coating

In each of the following Experimental Examples, the same resin (composition) as the resin (composition) used in forming the outer coating 14 was melt extruded to prepare a sample for measuring the storage modulus. It should be noted that for each of Experimental Example 1 and Experimental Example 3 to Experimental Example 7, an outer coating 14 including a first coating layer 141 and a second coating layer 142 was formed. Therefore, using the same resins as the resins used to form the respective coating layers, two samples for measuring the storage modulus were prepared.

With respect to each prepared sample, in accordance with JIS-K7244-1 (1998), using a dynamic viscoelasticity analyzer ("DVA200" manufactured by IT Keisokuseigyo K. K), under the conditions of strain 0.08%, frequency 10 Hz, and heating rate 10° C./min, the storage modulus was measured in the range of −50° C. to 200° C.

In each of Experimental Example 1 and Experimental Example 3 to Experimental Example 7, the storage modulus at −30° C. for the same resin as the resin used in forming the first coating layer 141 obtained by this measurement is the storage modulus at −30° C. of the first coating layer 141. Further, the storage modulus at −30° C. for the same resin as the resin used in forming the second coating layer 142 obtained by this measurement is the storage modulus at −30° C. of the second coating layer 142.

In Experimental Example 2, the storage modulus at −30° C. for the same resin as the resin used in forming the outer coating 14 obtained by this measurement is the storage modulus at −30° C. of the outer coating 14.

(2) Test of Resistance to Bending

For the multicore cables obtained in the following Experimental Examples, a test of resistance to bending was performed in accordance with JIS C 6851 (2006) (Optical Fiber Test Procedures).

Figure 4:
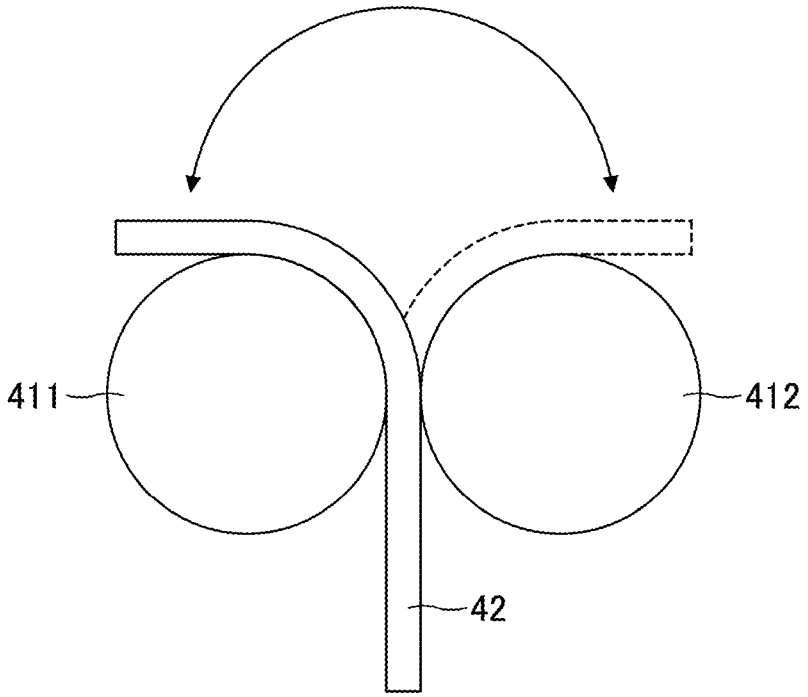
FIG. 4 is a diagram schematically illustrating a method of a test of resistance to bending in experimental examples.

Specifically, as illustrated in FIG. 4, between two mandrels 411 and 412 arranged horizontally and parallelly and having a diameter of 60 mm, a multicore cable 42 to be evaluated was interposed in the vertical direction. Bending the upper end by 90° in the horizontal direction to be in contact with the upper side of one mandrel 411, and then by bending it by 90° in the horizontal direction to be in contact with the upper side of the other mandrel 412 were repeated in a constant temperature bath at −30° C. This repetition was conducted while measuring the resistance value with connecting two conductors in the cable, and the number of times at which the resistance increased to ten times or more of the initial resistance value (the number of bends from bending to the right, bending to the left, and then returning to the right is defined as one) was defined as the index value of the test of resistance to bending. It should be noted that as the index value of the test of resistance to bending increases, that is, as the number of bends increases, the resistance to bending is excellent.

Experimental Examples

In the following, experimental conditions will be described. Experimental Example 1, Experimental Example 3 to Experimental Example 7 are Examples, and Experimental Example 2 is Comparative Example.

Experimental Example 1

A multicore cable 10 illustrated in FIG. 1 was prepared and evaluated. Specifically, the core 13 includes two power wires 11 and a twisted pair signal wires 12 containing two signal wires 121.

The power wires 11 each include seven first conductors 111. The first conductors 111 are each composed by twisting forty-eight conductors together, and the outer diameter of the first conductor 111 is 2.7 mm and the cross-sectional area of the first conductor 111 is 1.7 $mm^2$.

The twisted pair signal wire 12 is formed by twisting together the signal wires 121 each including three second conductors 1211. The second conductors 1211 area each composed by twisting sixteen conductors together, and the outer diameter of the second conductor 1211 is 1.6 mm and the cross-sectional area of the second conductor 1211 is 0.25 $mm^2$.

The core 13 is formed by twisting together the two power wires 11 and the twisted pair signal wire 12 along the longitudinal direction. Then, around the core, a thin paper is arranged as the suppression winding 15, and the outer coating 14 is arranged to cover the core 13.

The outer coating 14 includes a first coating layer 141 and a second coating layer 142. The first coating layer 141 had the thinnest thickness of 0.65 mm and was made of a polyethylene resin. The second coating layer 142 had a thickness of 0.5 mm and was formed by a material in which antimony trioxide, which is an inorganic material, was added to a polyurethane resin at a ratio of 12 parts by mass to 100 parts by mass of the polyurethane resin.

When measuring the storage modulus of the polyethylene resin at −30° C. used in forming the first coating layer 141, it was 200 MPa (indicated as "STORAGE MODULUS OF FIRST COATING LAYER" in Table 1). Thus, the storage modulus of the outer coating 14 in the area Y of FIG. 1 at −30° C. was 200 MPa. It should be noted that, for each of Experimental Example 3 to Experimental Example 7 below, the storage modulus at −30° C. of the material used in forming the first coating layer is the storage modulus at −30° C. of the outer coating 14 in the area Y of FIG. 1.

Also, when measuring the storage modulus at −30° C. of the material in which antimony trioxide, which is an inorganic material, was added to a polyurethane resin at a ratio of 12 parts by mass to 100 parts by mass of the polyurethane resin used in forming the second coating layer 142, it was 400 MPa (indicated as "STORAGE MODULUS OF SECOND COATING LAYER" in Table 1)). Thus, in the area X of FIG. 1 and the outer surface 14A, the storage modulus at −30° C. of the outer coating 14 is 400 MPa. It should be noted that, for each of Experimental Example 3 to Experimental Example 7, the storage modulus at −30° C. of the material used in forming the second coating layer is the storage modulus at −30° C. of the outer coating 14 in the area X of FIG. 1 and the outer surface 14A.

The evaluation results are indicated in Table 1.

Experimental Example 2

With the exception that the outer coating 14 was made of a material in which antimony trioxide, which is an inorganic material, was added to a polyurethane resin at a ratio of 15 parts by mass to 100 parts by mass of the polyurethane resin as a single layer, a multicore cable was prepared similarly to the case of Experimental Example 1.

When measuring the storage modulus at −30° C. of the material, in which antimony trioxide, which is an inorganic material, was added to a polyurethane resin at a ratio of 15 parts by mass to 100 parts by mass of the polyurethane resin, used in forming the outer coating 14, it was 650 MPa.

Thus, the storage modulus at −30° C. of the outer coating 14 in FIG. 1 is 650 MPa at any location of the outer coating 14.

Experimental Example 3

In the outer coating 14, the first coating layer 141 was made of a polyethylene resin having a density different from that of the first coating layer 141 of Experimental Example 1. Also, the second coating layer 142 was made of a polyurethane resin.

Other than the above, a multicore cable was prepared similarly to Experimental Example 1.

Experimental Example 4

In the outer coating 14, the first coating layer 141 was made of a polyethylene resin having a density different from that of the first coating layer 141 of each of Experimental Example 1 and Experimental Example 3. Also, the second coating layer 142 was made of a polyurethane resin.

Other than the above, a multicore cable was prepared similarly to Experimental Example 1.

Experimental Example 5

In the outer coating 14, the first coating layer 141 was made of a polyethylene resin having a density different from that of the first coating layer 141 in each of Experimental Example 1, Experimental Example 3, and Experimental Example 4. Also, the second coating layer 142 was made by a material obtained by adding 5 parts by mass of talc, which is an inorganic material, to 100 parts by mass of a polyurethane resin.

Other than the above, a multicore cable was prepared similarly to Experimental Example 1.

Experimental Example 6

In the outer coating 14, the first coating layer 141 was made of a polyethylene resin having a density different from that of the first coating layer 141 in each of Experimental Example 1 and Experimental Example 3 to Experimental Example 5. Also, the second coating layer 142 was made by a material obtained by adding 10 parts by mass of talc, which is an inorganic material, to 100 parts by mass of a polyurethane resin.

Other than the above, a multicore cable was prepared similarly to Experimental Example 1.

Experimental Example 7

In the outer coating 14, the first coating layer 141 was made of a polyethylene resin having a density different from that of the first coating layer 141 in each of Experimental Examples 1 and Experimental Example 3 to Experimental Example 6. Also, the second coating layer 142 was made by a material obtained by adding 12 parts by mass of talc, which is an inorganic material, to 100 parts by mass of a polyurethane resin.

Other than the above, a multicore cable was prepared similarly to Experimental Example 1.

Evaluation results are indicated in Table 1.

TABLE 1

| | STORAGE MODULUS OF FIRST COATING LAYER (MPa) | STORAGE MODULUS OF SECOND COATING LAYER (MPa) | TEST OF RESISTANCE TO BENDING (TIMES) |
|---|---|---|---|
| EXPERIMENTAL EXAMPLE 1 | 200 | 400 | 4,300,000 |
| EXPERIMENTAL EXAMPLE 2 | 650 | | 3,000,000 |
| EXPERIMENTAL EXAMPLE 3 | 100 | 300 | 4,350,000 |
| EXPERIMENTAL EXAMPLE 4 | 200 | 300 | 4,350,000 |
| EXPERIMENTAL EXAMPLE 5 | 300 | 400 | 4,000,000 |
| EXPERIMENTAL EXAMPLE 6 | 400 | 500 | 3,500,000 |
| EXPERIMENTAL EXAMPLE 7 | 500 | 600 | 3,300,000 |

According to the results indicated in Table 1, it could be confirmed that the multicore cables of Experimental Example 1 and Experimental Example 3 to Experimental Example 7, of which the storage modulus of the outer coating 14 at −30° C. is greater than or equal to 100 MPa and less than or equal to 600 MPa in the range of 0.1 mm from the outer surface 14A of the outer coating 14, that is, in the area X, are superior to the multicore cable of Experimental Example 2 that does not satisfy the above described requirements.

CLAUSES

Also, the present disclosure following aspects.

(Clause 1)

A multicore cable comprising:

a plurality of coated electric wires; and an outer coating that covers an outer periphery of the plurality of coated electric wires, wherein the coated electric wires each includes a conductor and an insulating layer that covers the conductor, and wherein, in a range of 0.1 mm from an outer surface of the outer coating, a storage modules of the outer coating at −30° C. is greater than or equal to 100 MPa and less than or equal to 600 MPa.

(Clause 2)

The multicore cable according to clause 1, wherein in a range of 0.1 mm from an inner surface of the outer coating located toward the plurality of coated electric wires, a storage modulus of a resin material of the outer coating at −30° C. may be less than a storage modulus of the outer surface of the outer coating at −30° C.

(Clause 3)

The multicore cable according to clause 1 or clause 2, wherein the outer coating includes a first coating layer and a second coating layer in order from the plurality of coated electric wires side, and wherein a storage modulus of the second coating layer at −30° C. is greater than or equal to 100 MPa and less than or equal to 600 MPa.

(Clause 4)

The multicore cable according to clause 3, wherein a storage modulus of the first coating layer at −30° C. is less than a storage modulus of the outer surface of the outer coating at −30° C.

(Clause 5)

The multicore cable according to clause 3 or clause 4, wherein the second coating layer contains a polyurethane resin including one or more kinds selected from antimony trioxide, aluminum hydroxide, magnesium hydroxide, and talc.

(Clause 6)

A multicore cable comprising:

a plurality of coated electric wires including a power wire and a twisted pair signal wire; and an outer coating that covers an outer periphery of the plurality of coated electric wires, wherein the power wire includes a plurality of conductors twisted together and an insulating layer that covers the plurality of conductors, wherein the twisted pair signal wire includes two signal wires twisted together, wherein the outer coating includes a first coating layer and a second coating layer in order from the plurality of coated electric wires side, wherein the second coating layer consists of only a polyurethane resin including one or more kinds selected from antimony trioxide, aluminum hydroxide, magnesium hydroxide, and talc and has a storage modulus at −30° C. of greater than or equal to 100 MPa and less than or equal to 600 MPa, and wherein a storage modulus of the first coating layer at −30° C. is less than a storage modulus of an outer surface of the outer coating at −30° C.

DESCRIPTION OF THE REFERENCE NUMERALS

10, 20, 30, 42: multicore cable
11: power wire
111: first conductor
112: first insulating layer
12: twisted pair signal wire
121: signal wire
1211: second conductor
1212: second insulating layer
13, 23, 33: core
14: outer coating
141: first coating layer
142: second coating layer
14A: outer surface
14B: inner surface
15: suppression winding
16: area
21: electric wire
211: third conductor
212: third insulating layer
411, 412: mandrel
A: dotted line
B: dotted line
L1: distance
L2: distance
X: area
Y: area

The invention claimed is:

1. A multicore cable comprising:

a plurality of coated electric wires; and an outer coating that covers an outer periphery of the plurality of coated electric wires, wherein the coated electric wires each includes a conductor and an insulating layer that covers the conductor, and wherein, in a range of 0.1 mm from an outer surface of the outer coating, a storage moduls of the outer coating at −30° C. is greater than or equal to 300 MPa and less than or equal to 500 MPa.

2. The multicore cable according to claim 1, wherein in the range of 0.1 mm from the outer surface of the outer coating, the storage moduls of the outer coating at −30° C. is greater than or equal to 300 MPa and less than or equal to 400 MPa.

3. The multicore cable according to claim 1, wherein in a range of 0.1 mm from an inner surface of the outer coating located toward the plurality of coated electric wires, a storage modulus of a resin material of the outer coating at −30° C. is less than a storage modulus of the outer surface of the outer coating at −30° C.

4. The multicore cable according to claim 1, wherein the outer coating includes a first coating layer and a second coating layer in order from the plurality of coated electric wires side, and wherein a storage modulus of the second coating layer at −30° C. is greater than or equal to 300 MPa and less than or equal to 500 MPa.

5. The multicore cable according to claim 4, wherein the storage modulus of the second coating layer at −30° C. is greater than or equal to 300 MPa and less than or equal to 400 MPa.

6. The multicore cable according to claim 4, wherein a storage modulus of the first coating layer at −30° C. is less than a storage modulus of the outer surface of the outer coating at −30° C.

7. The multicore cable according to claim 4, wherein the second coating layer contains a polyurethane resin including one or more kinds selected from antimony trioxide, aluminum hydroxide, magnesium hydroxide, and talc.

8. The multicore cable according to claim 1, wherein the outer coating includes a first coating layer and a second coating layer in order from the plurality of coated electric wires side, and wherein a storage modulus of the first coating layer at −30° C. is greater than or equal to 100 MPa and less than or equal to 500 MPa, and wherein a storage modulus of the second coating layer at −30° C. is greater than or equal to 100 MPa and less than or equal to 600 MPa, and the storage modulus of the first coating layer at −30° C. is less than a storage modulus of the outer surface of the outer coating at −30° C.

9. The multicore cable according to claim 1, wherein the outer coating includes a first coating layer and a second coating layer in order from the plurality of coated electric wires side, and wherein a storage modulus of the first coating layer at −30° C. is greater than or equal to 100 MPa and less than or equal to 400 MPa, and wherein a storage modulus of the second coating layer at −30° C. is greater than or equal to 300 MPa and less than or equal to 500 MPa, and the storage modulus of the first coating layer at −30° C. is less than a storage modulus of the outer surface of the outer coating at −30° C.

10. The multicore cable according to claim 1, wherein the outer coating includes a first coating layer and a second coating layer in order from the plurality of coated electric wires side, and wherein a storage modulus of the first coating layer at −30° C. is greater than or equal to 100 MPa and less than or equal to 300 MPa, and wherein a storage modulus of the second coating layer at −30° C. is greater than or equal to 300 MPa and less than or equal to 400 MPa, and the storage modulus of the first coating layer at −30° C. is less than a storage modulus of the outer surface of the outer coating at −30° C.

11. A multicore cable comprising:

a plurality of coated electric wires including a power wire and a twisted pair signal wire; and an outer coating that covers an outer periphery of the plurality of coated electric wires, wherein the power wire includes a plurality of conductors twisted together and an insulating layer that covers the plurality of conductors, wherein the twisted pair signal wire includes two signal wires twisted together, wherein the outer coating includes a first coating layer and a second coating layer in order from the plurality of coated electric wires side, wherein the second coating layer consists of only a polyurethane resin including one or more kinds selected from antimony trioxide, aluminum hydroxide, magnesium hydroxide, and talc and has a storage modulus at −30° C. of greater than or equal to 300 MPa and less than or equal to 500 MPa, and wherein a storage modulus of the first coating layer at −30° C. is less than a storage modulus of an outer surface of the outer coating at −30° C.

12. A multicore cable comprising:

a plurality of coated electric wires; and an outer coating that covers an outer periphery of the plurality of coated electric wires, wherein the coated electric wires each includes a conductor and an insulating layer that covers the conductor, and wherein, in a range of 0.1 mm from an outer surface of the outer coating, a storage moduls of the outer coating at −30° C. is greater than or equal to 100 MPa and less than or equal to 600 MPa.

* * * * *